US010641274B2

(12) United States Patent
Chien et al.

(10) Patent No.: US 10,641,274 B2
(45) Date of Patent: May 5, 2020

(54) OUTER ROTOR TYPE FAN STRUCTURE

(71) Applicant: DELTA ELECTRONICS, INC., Taoyuan County (TW)

(72) Inventors: Han-En Chien, Taoyuan County (TW); Hung-Chi Chen, Taoyuan County (TW); Meng-Yu Chen, Taoyuan County (TW); Che-Hung Lin, Taoyuan County (TW); Chao-Chun Kung, Taoyuan County (TW)

(73) Assignee: DELTA ELECTRONICS, INC., Taoyuan County (TW)

( * ) Notice: Subject to any disclaimer, the term of this patent is extended or adjusted under 35 U.S.C. 154(b) by 409 days.

(21) Appl. No.: 14/834,744

(22) Filed: Aug. 25, 2015

(65) Prior Publication Data

US 2016/0363125 A1 Dec. 15, 2016

(30) Foreign Application Priority Data

Jun. 10, 2015 (CN) ..... 2015 1 0315431

(51) Int. Cl.
*F04D 25/06* (2006.01)
*F04D 17/16* (2006.01)
*F04D 29/42* (2006.01)

(52) U.S. Cl.
CPC ..... *F04D 25/0633* (2013.01); *F04D 17/16* (2013.01); *F04D 25/0646* (2013.01); *F04D 29/4226* (2013.01)

(58) Field of Classification Search
CPC .. F04D 25/0633; F04D 25/0646; F04D 17/16; F04D 25/062; F04D 25/064; F04D 29/663; F04D 29/329; F04D 29/668; F04D 29/263; H02K 5/24; H02K 1/30; H02K 21/22; H02K 29/00
USPC ..... 417/354, 423.8; 310/67 R, 58, 62
See application file for complete search history.

(56) References Cited

U.S. PATENT DOCUMENTS 2,538,196 A * 1/1951 Hildebrand ..... F04D 25/064 310/66
2,895,666 A * 7/1959 Girdwood ..... F04D 25/064 29/889.4
5,644,178 A * 7/1997 Halm ..... H02K 3/50 310/43
5,977,671 A * 11/1999 Kim ..... H02K 29/08 310/89

(Continued)

*Primary Examiner* — Patrick Hamo
*Assistant Examiner* — David N Brandt
(74) *Attorney, Agent, or Firm* — Hauptman Ham, LLP

(57) ABSTRACT

An outer rotor type fan structure includes a stator assembly, an outer rotor assembly, a front lateral shielding sheet and an impeller. The stator assembly includes a stator core and a plurality of coils. The outer rotor assembly corresponds to and covers the stator assembly. The outer rotor assembly includes a plurality of magnets and a rotor yoke. The plurality of magnets is disposed corresponding to the plurality of coils. The front lateral shielding sheet is a metallic sheet, the front lateral shielding sheet is disposed between the stator assembly and the outer rotor assembly, and the front lateral shielding sheet corresponds to and covers the plurality of coils. The impeller includes a plurality of blades. The rotor yoke drives the plurality of blades rotating. Thereby, the outer rotor type fan structure can be shielded and the fan can operate properly.

7 Claims, 8 Drawing Sheets

(56) References Cited

U.S. PATENT DOCUMENTS 6,288,329 B1 * 9/2001 Kopp ..... H05K 9/0073 174/378
7,667,359 B2 * 2/2010 Lee ..... H02K 5/04 310/43
7,911,089 B2 * 3/2011 Jang ..... F04D 25/08 310/43
8,492,939 B2 * 7/2013 Hasegawa ..... F04D 29/023 310/43
8,506,264 B2 * 8/2013 Horng ..... F04D 25/0606 310/52
8,721,306 B2 * 5/2014 Andersen ..... F04D 29/628 417/423.14
8,922,076 B2 * 12/2014 Hsieh ..... H02K 5/128 310/43
8,946,948 B2 * 2/2015 Adachi ..... H02K 5/10 310/194
9,506,473 B2 * 11/2016 Chang ..... F04D 25/0646
9,523,368 B2 * 12/2016 Chang ..... F04D 25/0646
2007/0085426 A1 * 4/2007 Lee ..... H02K 1/04 310/43
2007/0145842 A1 * 6/2007 Zhu ..... F04D 29/582 310/88
2008/0100172 A1 * 5/2008 Yang ..... H02K 1/145 310/257
2010/0014035 A1 * 1/2010 Takamatsu ..... H05K 1/0215 349/122
2010/0109465 A1 * 5/2010 Yang ..... F04D 25/088 310/156.12
2011/0050011 A1 * 3/2011 Rhee ..... H02K 5/00 310/71
2013/0162072 A1 * 6/2013 Mizutani ..... H02K 3/522 310/71
2013/0342055 A1 * 12/2013 Lee ..... H02K 11/0089 310/71
2014/0112807 A1 * 4/2014 Chen ..... H02K 5/10 417/423.7
2015/0108859 A1 * 4/2015 Nakazumi ..... H02K 5/10 310/71
2015/0333596 A1 * 11/2015 Berkouk ..... H05K 1/18 310/71

* cited by examiner

OUTER ROTOR TYPE FAN STRUCTURE

TECHNICAL FIELD

The disclosure relates to a fan, more particularly to an outer rotor type fan which can be shielded.

BACKGROUND

In general, electronic elements generate heat when operating. Thus, a heat dissipating device is usually disposed inside an electronic device so as to remove the great amount of heat generated by the electronic element. Thereby, it can reduce the heat impact on the lifespan and reliability of the electronic device.

Fans are common heat dissipating devices. A fan is constituted by a motor and an impeller driven by the motor. However, the coils of the motor would radiate electromagnetic waves when operating, such that there would be electromagnetic interferences between the fan and electrical equipment or other electronic products when a user uses the fan. Specifically, when a plurality of electronic products is disposed inside a narrow space, the electromagnetic interference would cause the electronic products unable to operate properly and would cause safety issues.

Thus, it is important to shield the electromagnetic wave radiated by the coils of the fan motors so as to comply with the regulations of the standard for electromagnetic wave and to avoid the interference of electromagnetic wave between the fan and other devices. That is, it is important to make sure that the fan and other devices to operate properly.

SUMMARY

One purpose of the disclosure is to provide an outer rotor type fan structure, such that the outer rotor type fan structure can be shielded and the fan can operate properly.

One of embodiment of the disclosure provides an outer rotor type fan structure, comprising a stator assembly, an outer rotor assembly, a front lateral shielding sheet and an impeller. The stator assembly comprises a stator core and a plurality of coils winding the stator core. The outer rotor assembly corresponds to and covers the stator assembly. The outer rotor assembly comprises a plurality of magnets and a rotor yoke combined with the plurality of magnets. The plurality of magnets is disposed corresponding to the plurality of coils. The front lateral shielding sheet is a metallic sheet, the front lateral shielding sheet is disposed between the stator assembly and the outer rotor assembly, and the front lateral shielding sheet corresponds to and covers the plurality of coils. The impeller comprises a plurality of blades. The rotor yoke drives the plurality of blades rotating.

One of embodiment of the disclosure provides another outer rotor type fan structure. The front lateral shielding sheet of the outer rotor type fan structure is electrically connected with the circuit board and is grounded by a conductive connecting unit (a conductive screw and a ground screw). Thereby, the plurality of coils can be better shielded.

As compared with conventional fans, the front lateral shielding sheet of the outer rotor type fan is combined to the stator assembly. Since the size of the front lateral shielding sheet is less than the peripheral edge of the stator assembly, the coils can be shielded without affecting the relative rotation between the stator assembly and the outer rotor assembly. Further, the front lateral shielding sheet is electrically connected with the circuit board and is grounded by a conductive connecting unit (a conductive screw and a ground screw), so that a better shielding performance is achieved. In addition, a back lateral shielding sheet is disposed at the bottom of the stator assembly of the outer rotor type fan further, such that the front side and the back side of the stator assembly can be shielded for preventing electromagnetic interference.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Figure 1:
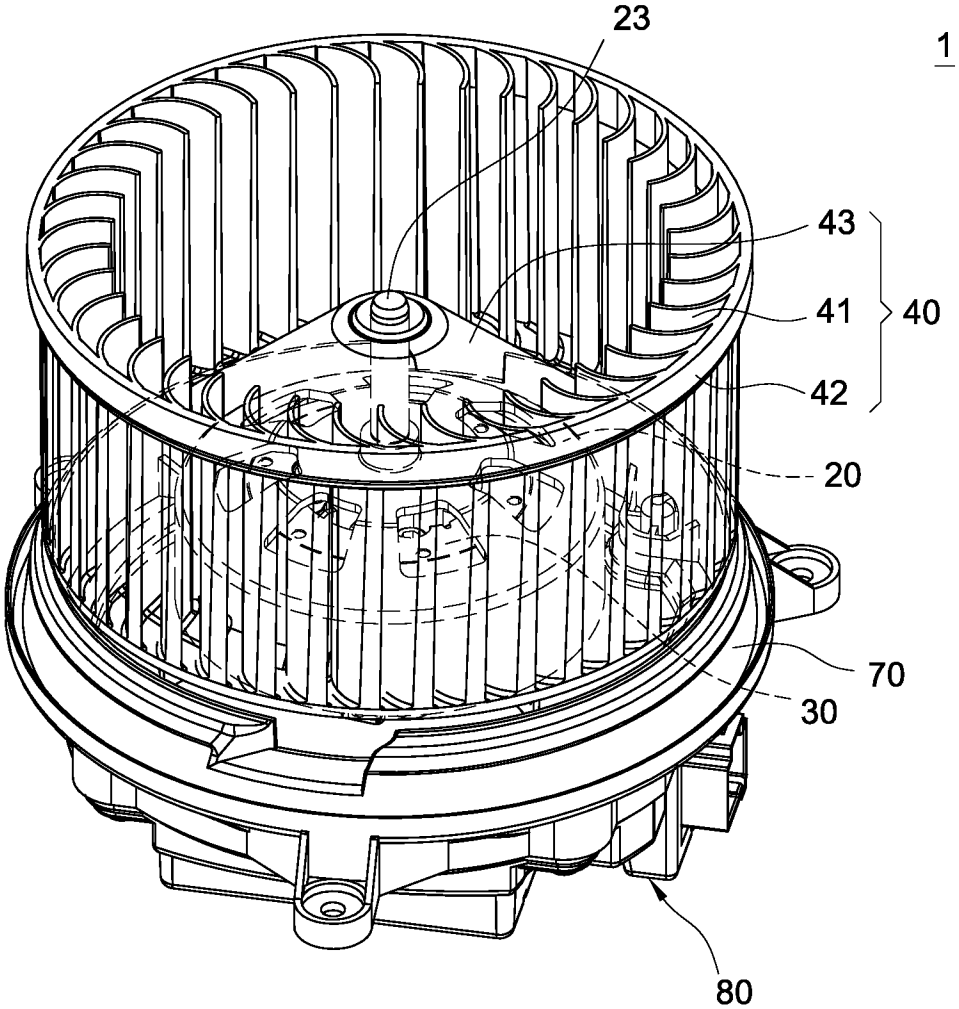
FIG. 1 is a schematic view of an outer rotor type fan structure of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
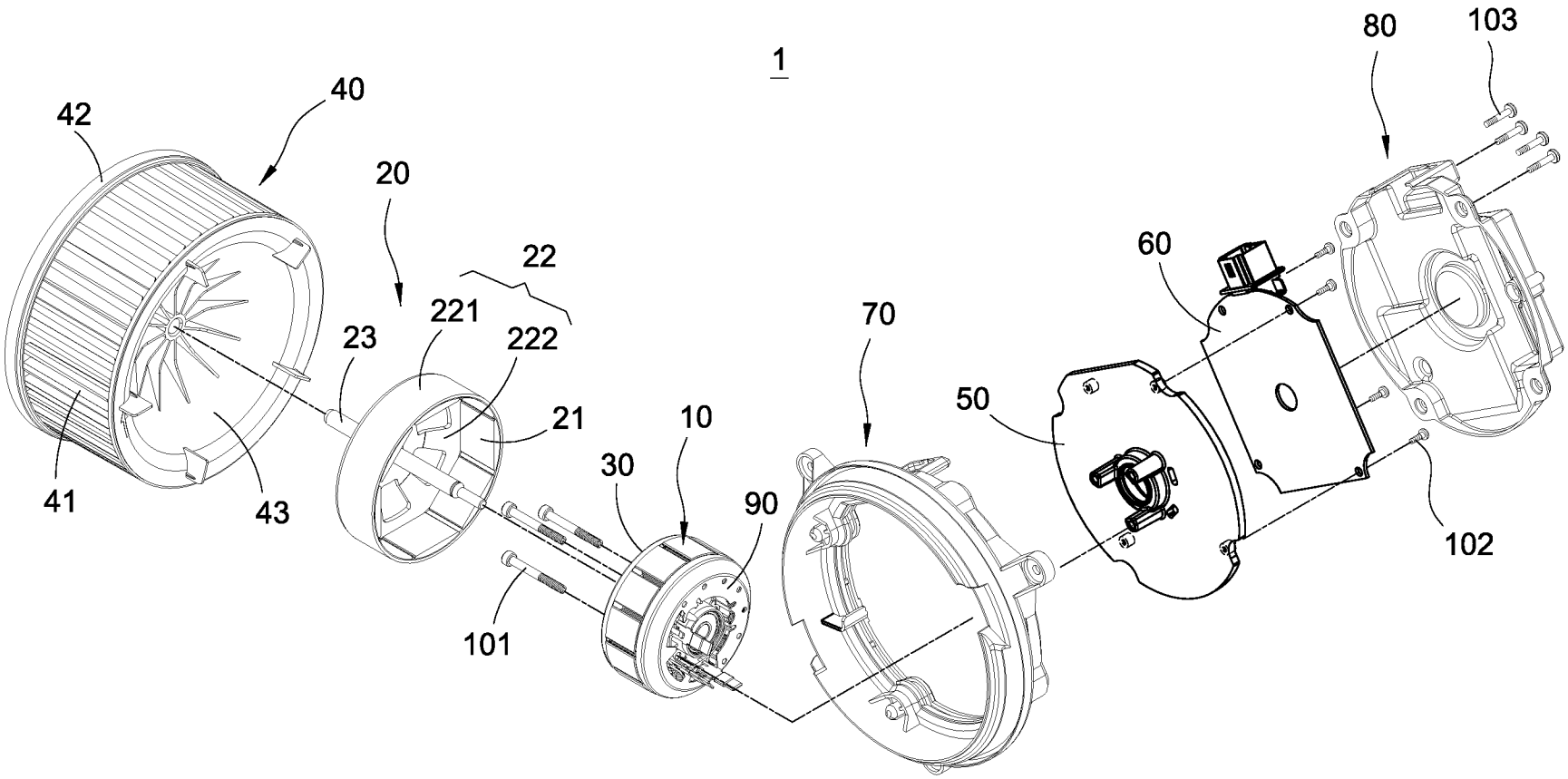
FIG. 2 is an exploded view of the outer rotor type fan structure of the disclosure.
Figure 3:
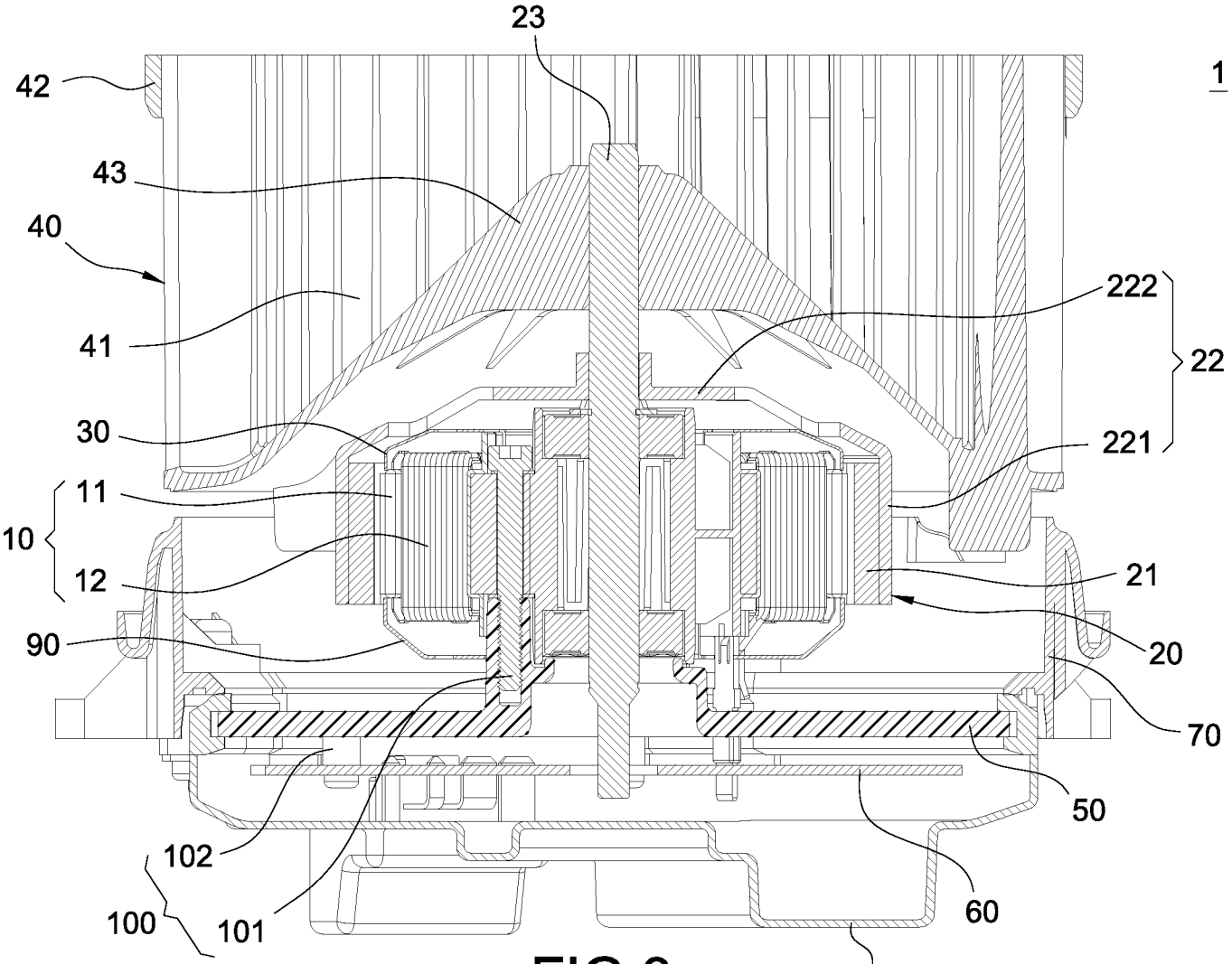
FIG. 3 is a sectional view of the outer rotor type fan structure of the disclosure.

Referring to FIGS. 1 to 3, FIG. 1 is a schematic view of an outer rotor type fan structure of the disclosure; FIG. 2 is an exploded view of the outer rotor type fan structure of the disclosure; FIG. 3 is a sectional view of the outer rotor type fan structure of the disclosure. According to the disclosure, the outer rotor type fan structure 1 comprises a stator assembly 10, an outer rotor assembly 20, a front lateral shielding sheet 30 and an impeller 40. The stator assembly 10 is disposed corresponding to the outer rotor assembly 20. The front lateral shielding sheet 30 is combined to the stator assembly 10 for shielding the stator assembly 10. The outer rotor assembly 20 drives the impeller 40 rotating and further producing airflows.

The stator assembly 10 comprises a stator core 11 and a plurality of coils 12 winding the stator core 11. In this embodiment, the stator core 11 is stacked by a plurality of silicon steel sheets. The plurality of coils 12 winds and forms a plurality of intervals 120.

The outer rotor assembly 20 corresponds to and covers the stator assembly 10. The outer rotor assembly 20 comprises a plurality of magnets 21 and a rotor yoke 22 combined with the plurality of magnets 21. The plurality of magnets 21 is disposed corresponding to the plurality of coils 12. In this embodiment, the rotor yoke 22 comprises an annular sheet 221 surrounding the stator assembly 10 and a supporting board 222 formed at one side of the annular sheet 221. Also, the plurality of magnets 21 is disposed at the inner surface of the annular sheet 221 corresponding to the stator assembly 10 with intervals. In addition, the outer rotor assembly 20 further comprises a shaft 23, and the shaft 23 passes through the rotor yoke 22.

In addition, the front lateral shielding sheet 30 is a metallic sheet. Preferably, the front lateral shielding sheet 30 is an annular sheet made of aluminum. The front lateral shielding sheet 30 is disposed between the stator assembly 10 and the outer rotor assembly 20, and the front lateral shielding sheet 30 corresponds to and covers the plurality of coils 12. The structure of the front lateral shielding sheet 30 would be further described in the following paragraphs.

The impeller 40 comprises a plurality of blades 41. The rotor yoke 22 drives the plurality of blades 41 rotating. In one embodiment of the disclosure, the impeller 40 further comprises an impeller frame 42 and an impeller hub 43. The impeller hub 43 extends from the impeller frame 42 and is formed inside the impeller frame 42. In addition, the plurality of blades 41 is combined to the peripheral edge of the impeller frame 42. The shaft 23 passes through the impeller hub 43.

Thereby, when external power is applied to the stator assembly 10, the stator assembly 10 generates electromagnetic filed, interacts with the outer rotor assembly 20 and drives the shaft 23 rotating. Meanwhile, the shaft 23 further drives the impeller hub 43 (the impeller 40) rotating. In other words, the impeller 40 rotates and generates compulsory airflow by the electromagnetic effect between the outer rotor assembly 20 and the stator assembly 10 so as to dissipate heat.

In one embodiment of the disclosure, the outer rotor type fan 1 further comprises a bottom plate 50, a circuit board 60, a supporting base 70 and a back cover 80. The stator assembly 10 is disposed on a lateral surface of the bottom plate 50. The circuit board 60 is disposed on another lateral surface of the bottom plate 50 corresponding to the stator assembly 10. In addition, the impeller 40 and the outer rotor assembly 20 are disposed at the same side of the supporting base 70. The back cover 80 supports the bottom plate 50 and the circuit board 60, and the back cover 80 is combined to another side of the supporting base 70 corresponding to the impeller 40. In one embodiment of the disclosure, the back cover 80 is combined to the supporting base 70 by a plurality of bottom cover screws 103.

Figure 4:
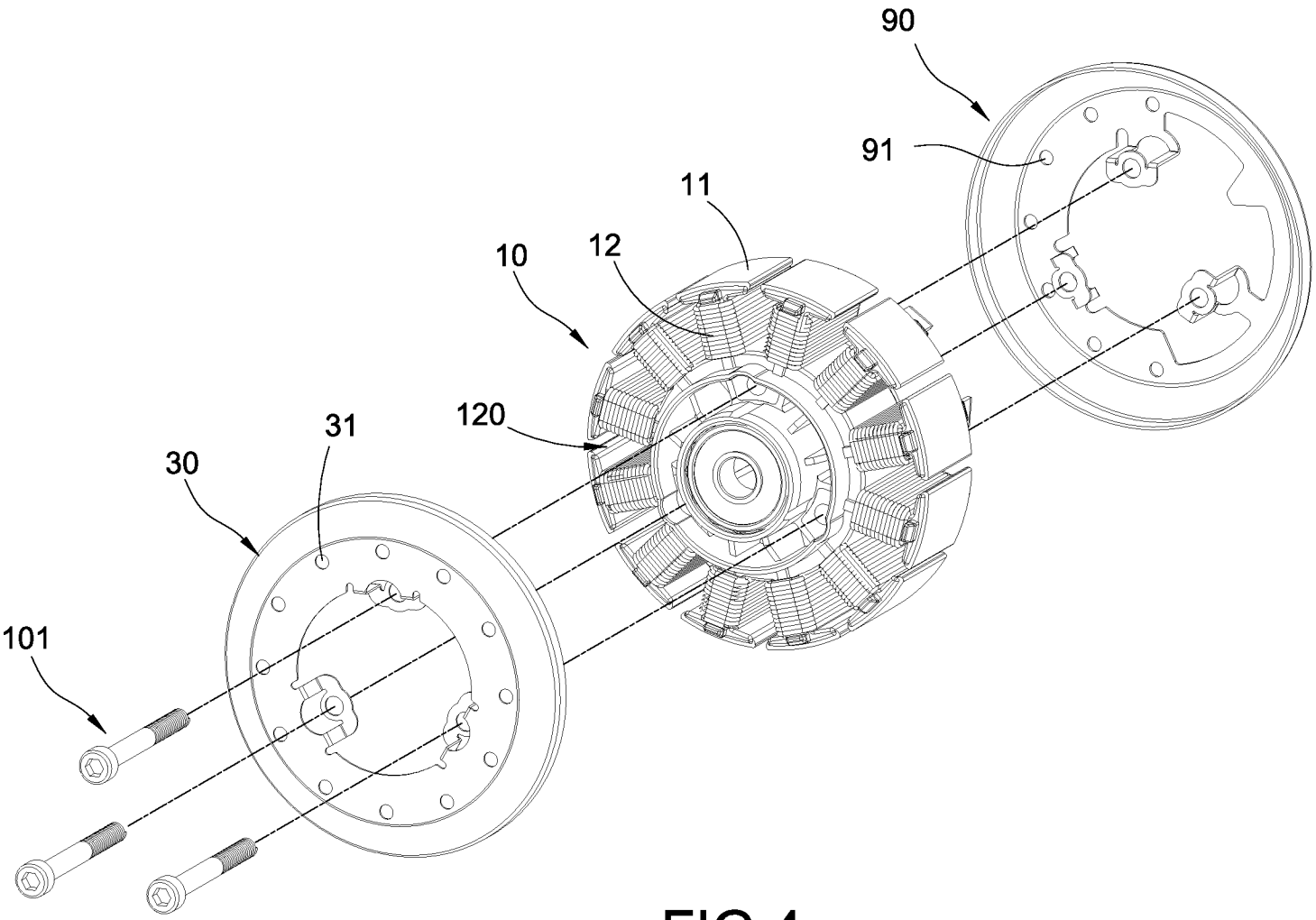
FIG. 4 is an exploded view of the stator assembly and the shielding sheet of the disclosure.
Figure 5:
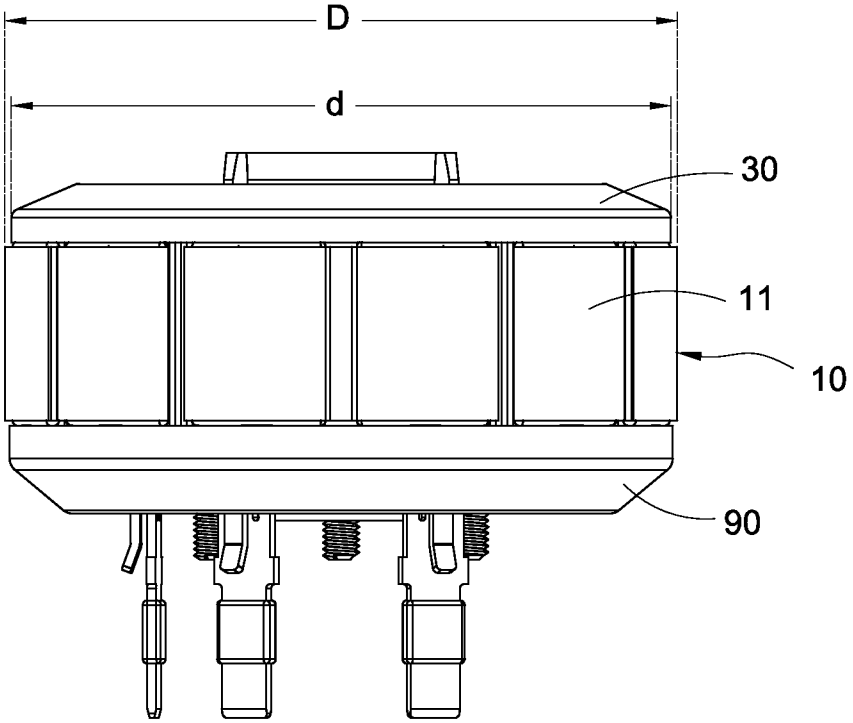
FIG. 5 is a lateral view of the stator assembly combined with the shielding sheet of the disclosure.
Figure 6:
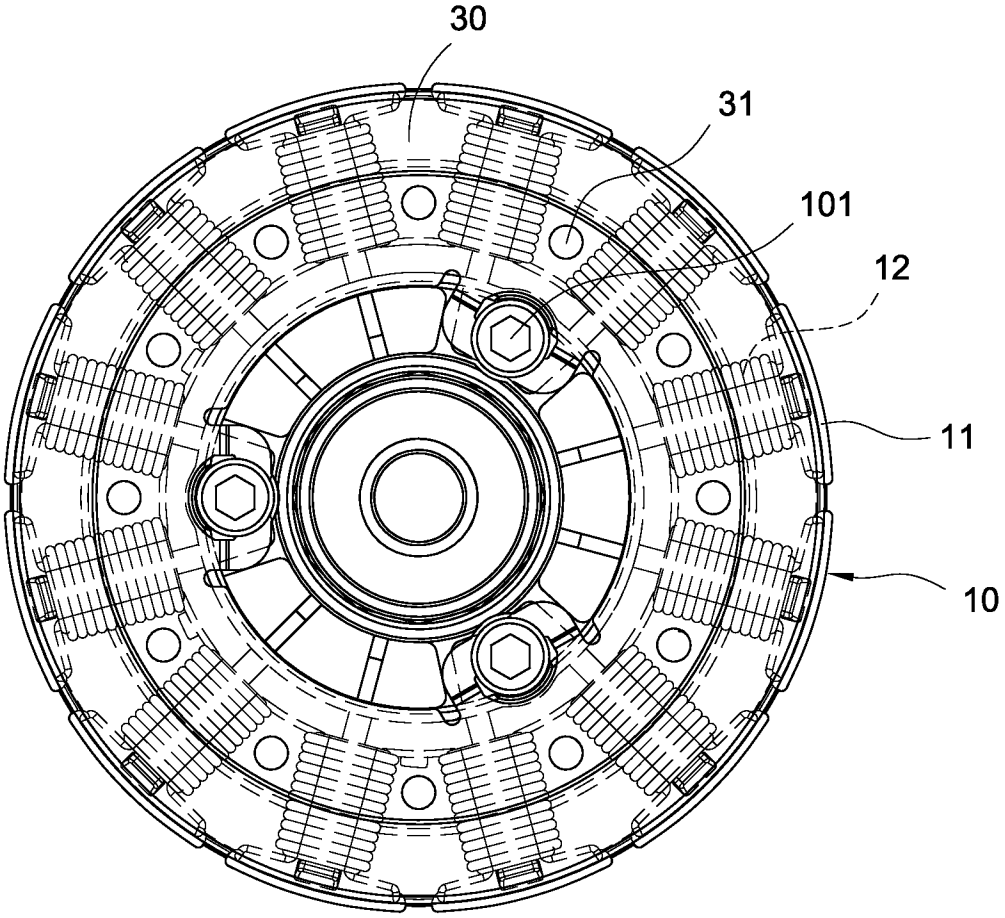
FIG. 6 is a top view of the stator assembly combined with the shielding sheet of the disclosure.

Referring to FIGS. 4 to 6, FIG. 4 is an exploded view of the stator assembly and the shielding sheet of the disclosure; FIG. 5 is a lateral view of the stator assembly combined with the shielding sheet of the disclosure; FIG. 6 is a top view of the stator assembly combined with the shielding sheet of the disclosure. As shown in FIG. 4, in one embodiment of the disclosure, the outer rotor type fan 1 further comprises a back lateral shielding sheet 90 and at least one conductive connecting unit 100. The back lateral shielding sheet 90 is a metallic sheet, and the back lateral shielding sheet 90 is disposed between the stator assembly 10 and the bottom plate 50. In this embodiment, the conductive connecting unit 100 comprises a connecting screw 101 and a ground screw 102.

Preferably, the back lateral shielding sheet 90 is an annular sheet made of aluminum, which is the same to the front lateral shielding sheet 30. Further, the connecting screw 101 passes through the front lateral shielding sheet 30, the stator assembly 10, the back lateral shielding sheet 90 and the bottom plate 50 in sequence. In addition, the bottom of the bottom plate 50 connects with the circuit board 60 by the ground screw 102. Thereby, the front lateral shielding sheet 30 is electrically connected with the circuit board 60 by the conductive connecting unit 100 (the connecting screw 101 and the ground screw 102) (referring to FIG. 3).

Referring to FIG. 5, when the front lateral shielding sheet 30 is combined to the stator assembly 10, the size (the diameter "d") of the front lateral shielding sheet 30 is less than or equal to the peripheral edge (the diameter "D") of the stator assembly 10. As shown in the lateral view, the peripheral edge of the front lateral shielding sheet 30 corresponds to the inner side of the stator core 11. In other words, the peripheral edge of the stator assembly 10 is exposed between the front lateral shielding sheet 30 and the back lateral shielding sheet 90. Accordingly, the front lateral shielding sheet 30 and the back lateral shielding sheet 90 can shield the coils 12 and do not affect the relative rotation between the stator assembly 10 and the external rotor assembly 20 so as to prevent the electromagnetic interference from the environment affecting the coils 12 or to prevent the electromagnetic interference from the coils 12 affecting external electronic devices.

It should be noticed that the front lateral shielding sheet 30 and the back lateral shielding sheet 90 are electrically connected with the circuit board 60 by the conductive connecting unit 100 (the connecting screw 101 and the ground screw 102) and be grounded. Thus, a better shielding performance can be achieved.

As shown in FIGS. 4 and 6, the plurality of coils 12 of the stator assembly 10 winds and forms a plurality of intervals 120. The front lateral shielding sheet 30 has a plurality of vents 31 corresponding to the positions of the plurality of intervals 120. Similarly, the back lateral shielding sheet 90 also has a plurality of vents 91 corresponding to the positions of the intervals 120. Thereby, hot air can dissipate from the vents 31 and 91. In addition, the vents 31 and 91 are not absolutely axially disposed above the coils 12, but the intervals 120, such that the vents 31 and 91 do not affect the shielding performance.

Figure 7:
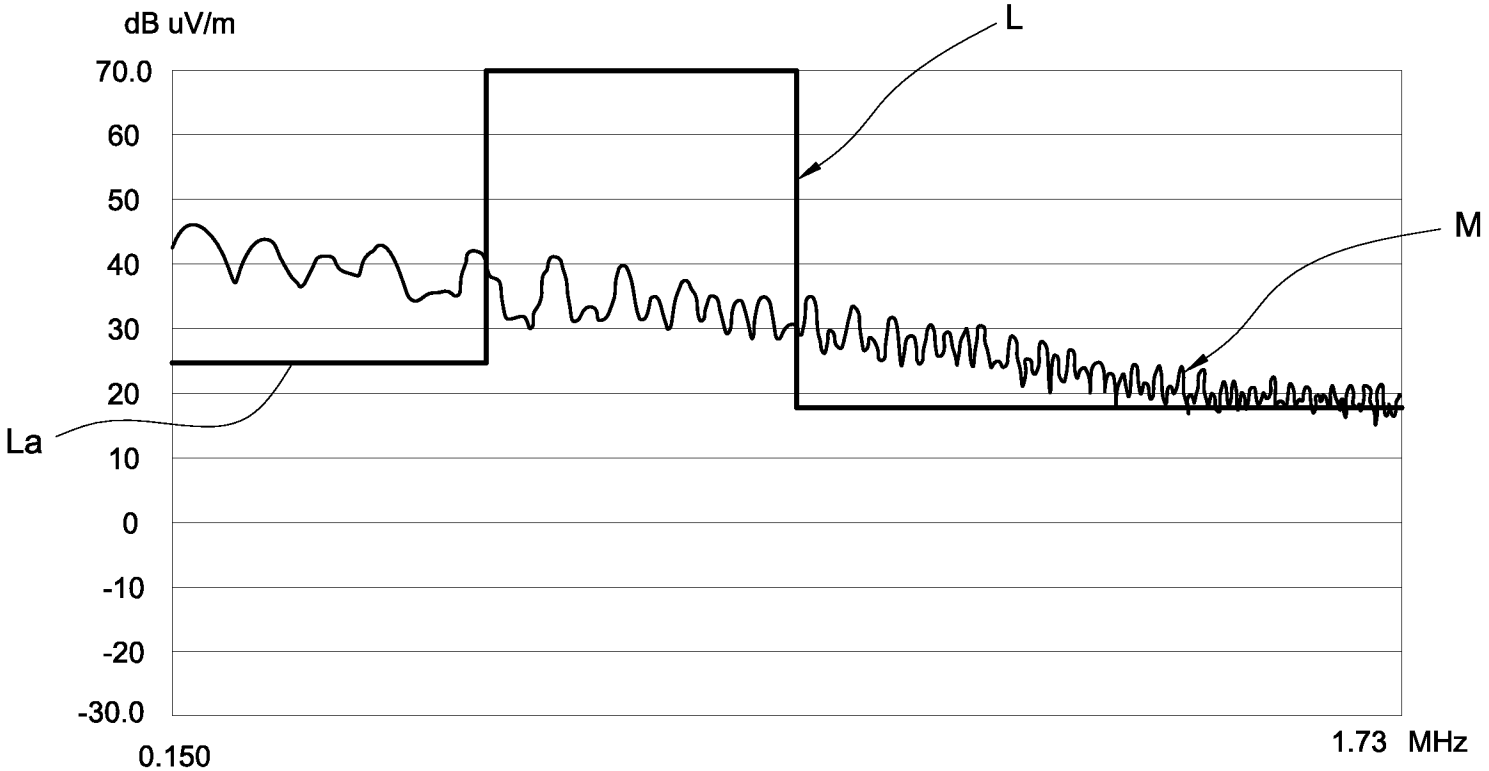
FIG. 7 is a test result of the electromagnetic compatibility of the stator assembly before the front lateral shielding sheet is disposed in the stator assembly according to the disclosure.
Figure 8:
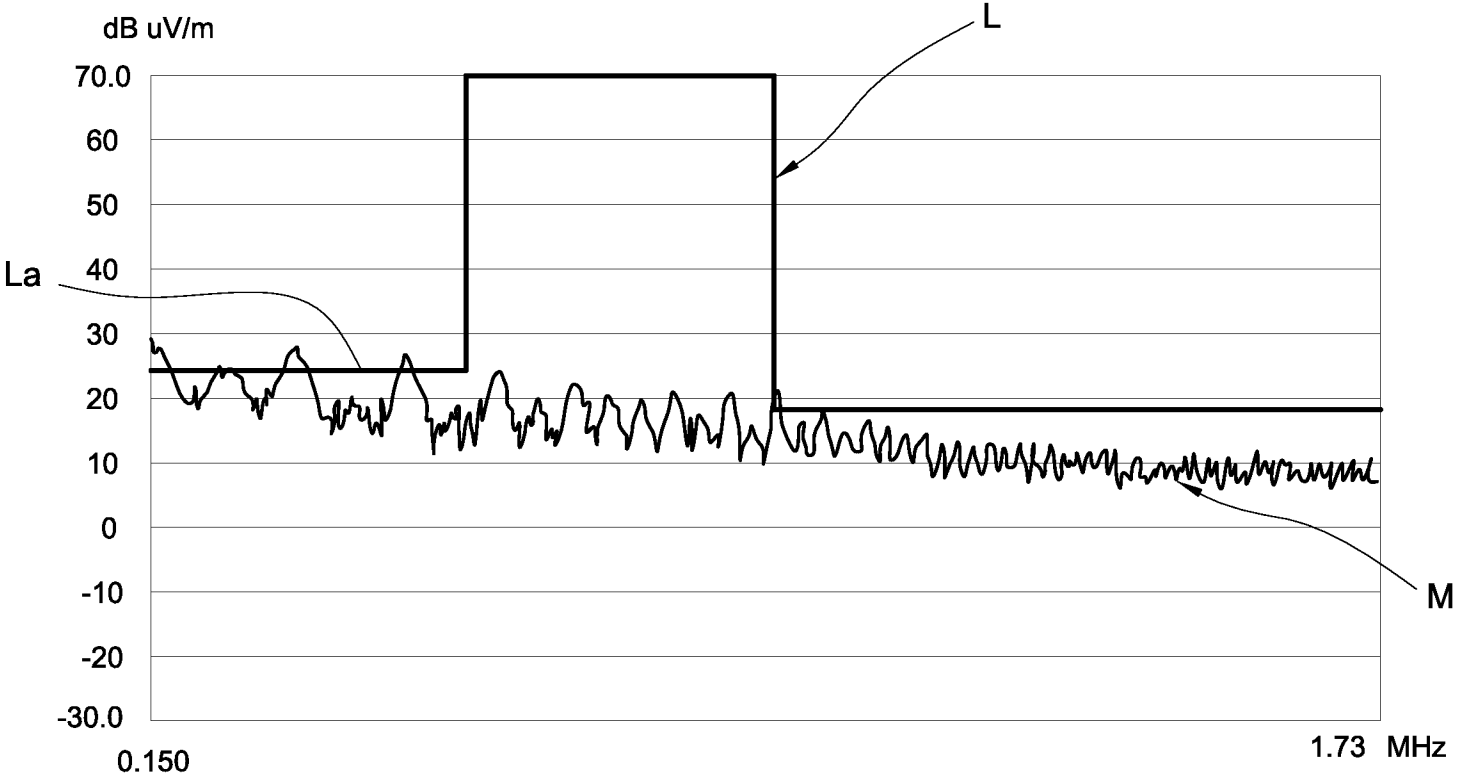
FIG. 8 is a test result of the electromagnetic compatibility of the stator assembly after the front lateral shielding sheet is disposed in the stator assembly according to the disclosure.

Referring to FIGS. 7 and 8, FIG. 7 is a test result of the electromagnetic compatibility of the stator assembly before the front lateral shielding sheet is disposed in the stator assembly according to the disclosure; FIG. 8 is a test result of the electromagnetic compatibility of the stator assembly after the front lateral shielding sheet is disposed in the stator assembly according to the disclosure. The shielding performance of the stator assembly when the front lateral shielding sheet 30 is disposed is examined by ElectroMagnetic Compatibility (EMC). As shown in FIG. 7, M line is the intensity (dBuV/m) of radiation when the front lateral shielding sheet 30 is not disposed in the stator assembly 10 in different frequencies (MHz), and L line is a curve of radiation intensity regulated in MBN 10284. As shown in FIG. 7, the stator assembly 10 fails to comply with the regulations in low-frequency region (La section) regulated in MBN 10284 by a great amount, such that the stator assembly 10 cannot meet the requirement.

Referring to FIG. 8, M line is the intensity (dBuV/m) of radiation when the front lateral shielding sheet 30 is disposed in the stator assembly 10 in different frequencies (MHz), and L line is a curve of radiation intensity regulated in MBN 10284. As shown in FIG. 8, when the front lateral shielding sheet 30 is disposed in the stator assembly 10, all the radiation intensities in different frequencies decrease, especially in low-frequency region (La section), the radiation intensity is really closed to the regulation of MBN10284. According to the above experiments, the front lateral shielding sheet 30 can lower the radiation intensity.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An outer rotor type fan structure, comprising:

a stator assembly, comprising a stator core and a plurality of coils winding the stator core;

an outer rotor assembly, corresponding to and covering the stator assembly, wherein the outer rotor assembly comprises a shaft, a plurality of magnets, and a rotor yoke combined with the plurality of magnets, the plurality of magnets is disposed corresponding to the plurality of coils;

a front lateral shielding plate, wherein the front lateral shielding plate is a metallic plate and does not contact with the coils, the front lateral shielding plate is disposed between the stator assembly and the outer rotor assembly, and the front lateral shielding plate covers one side of the plurality of coils and exposes one side of the stator core facing the plurality of magnets such that the stator assembly interacts with the outer rotor assembly to cause the shaft to rotate;

an impeller, comprising a plurality of blades, wherein the rotor yoke drives the plurality of blades by causing the shaft to rotate;

a bottom plate and a circuit board, wherein the stator assembly and the circuit board are disposed on opposite sides of the bottom plate;

a supporting base and a back cover, wherein the supporting base is a hollow annular seat having a diameter greater than an outer diameter of the blades with respect to the shaft, the back cover supports the bottom plate and the circuit board, the bottom plate is accommodated within an annular groove on a supporting base side of the back cover, the supporting base is stacked on the back cover, the back cover and the impeller are located at opposite sides of the supporting base, the circuit board is enclosed by the bottom plate and the back cover, and the bottom plate is substantially parallel to the back cover; and a back lateral shielding plate, wherein the back lateral shielding plate is a metallic sheet, and the back lateral shielding plate is disposed between the stator assembly and the bottom plate, the peripheral edge of the stator assembly is exposed between the front lateral shielding plate and the back lateral shielding plate, and the front lateral shielding plate and the back lateral shielding plate cover opposite sides of the stator assembly.

2. The outer rotor type fan structure according to claim 1, wherein the front lateral shielding plate is an annular sheet.

3. The outer rotor type fan structure according to claim 2, wherein a diameter of the front lateral shielding sheet plate is less than or equal to a diameter of the stator assembly.

4. The outer rotor type fan structure according to claim 3, wherein the stator core is stacked by a plurality of silicon steel sheets, and the peripheral edge of the front lateral shielding plate corresponds to an inner side of the stator core.

5. The outer rotor type fan structure according to claim 1, further comprising a conductive connecting unit, wherein the front lateral shielding plate is electrically connected with the circuit board by the conductive connecting unit.

6. The outer rotor type fan structure according to claim 5, wherein the conductive connecting unit comprises a connecting screw and a ground screw, the connecting screw passes through the front lateral shielding plate, the stator assembly and the bottom plate in sequence, and the bottom plate connects with the circuit board by the ground screw.

7. The outer rotor type fan structure according to claim 1, wherein the plurality of coils are wound onto the stator core and form a plurality of coil windings separated by a plurality of intervals, and the front lateral shielding plate has a plurality of vents corresponding to the positions of the intervals.

* * * * *